US010611185B2

(12) United States Patent
Xie

(10) Patent No.: US 10,611,185 B2
(45) Date of Patent: Apr. 7, 2020

(54) LIQUID INK WRITING INSTRUMENT

(71) Applicant: QINGDAO CHANGLONG STATIONERY CO., LTD., Qingdao, Shandong (CN)

(72) Inventor: Sipeng Xie, Qingdao (CN)

(73) Assignee: QINGDAO CHANGLONG STATIONERY CO., LTD., Qingdao (CN)

( * ) Notice: Subject to any disclaimer, the term of this patent is extended or adjusted under 35 U.S.C. 154(b) by 0 days.

(21) Appl. No.: 16/086,289

(22) PCT Filed: Jan. 9, 2018

(86) PCT No.: PCT/CN2018/071970
§ 371 (c)(1),
(2) Date: Sep. 18, 2018

(87) PCT Pub. No.: WO2018/205669
PCT Pub. Date: Nov. 15, 2018

(65) Prior Publication Data

US 2019/0283485 A1 Sep. 19, 2019

(30) Foreign Application Priority Data

May 12, 2017 (CN) ..... 2017 1 0335298
May 12, 2017 (CN) ..... 2017 2 0528082

(51) Int. Cl.
*B43K 5/10* (2006.01)
*B43K 1/12* (2006.01)
(Continued)

(52) U.S. Cl.
CPC ..... *B43K 5/10* (2013.01); *B43K 1/12* (2013.01); *B43K 5/18* (2013.01); *B43K 7/01* (2013.01);
(Continued)

(58) Field of Classification Search
CPC ..... B43K 5/10; B43K 5/18; B43K 5/1809; B43K 5/02; B43K 1/12; B43K 7/08;
(Continued)

(56) References Cited

U.S. PATENT DOCUMENTS 4,556,336 A 12/1985 Sano et al.
6,474,894 B1 * 11/2002 Baik ..... B43K 8/04 401/198
(Continued)

FOREIGN PATENT DOCUMENTS

CN 1181982 C 12/2004
CN 100467282 C 3/2009
(Continued)

OTHER PUBLICATIONS

Apr. 8, 2018 International Search Report issued in International Patent Application No. PCT/CN2018/071970.

*Primary Examiner* — David J Walczak
(74) *Attorney, Agent, or Firm* — Oliff PLC

(57) ABSTRACT

A liquid ink instrument, including: a pen body, a writing element mounted on the head of the pen body, an ink absorber mounted at the rear end of the writing element; a fiber ink feeder mounted in the body penetrates the ink absorbing body, the front end in contact with the writing element, the rear end communicated with the ink cartridge; at least one air-liquid balancer in the axial direction, the air-liquid balancer installed between the recited fiber ink feeder and the body; having one or more air-liquid exchange grooves penetrating through the outer circumferential surface; having an overflow groove on a radial surface of the air-liquid balancer, one end contacted to fiber ink feeder, and the other end communicating with air-liquid exchange groove; a gas-free fit or an interference fit adopted between
(Continued)

the outer circumferential surface of the fiber ink feeder and the inner wall of the air-liquid balancer.

14 Claims, 7 Drawing Sheets

(51) Int. Cl.

| | |
|---|---|
| ***B43K 5/18*** | (2006.01) |
| ***B43K 8/02*** | (2006.01) |
| ***B43K 7/08*** | (2006.01) |
| ***B43K 8/04*** | (2006.01) |
| ***B43K 8/08*** | (2006.01) |
| ***B43K 7/01*** | (2006.01) |
| ***B43K 7/02*** | (2006.01) |

(52) U.S. Cl.
CPC ..... *B43K 7/02* (2013.01); *B43K 7/08* (2013.01); *B43K 8/02* (2013.01); *B43K 8/04* (2013.01); *B43K 8/08* (2013.01)

(58) Field of Classification Search
CPC . B43K 7/105; B43K 8/02; B43K 8/03; B43K 8/04; B43K 8/06; B43K 8/08; B43K 8/18
See application file for complete search history.

(56) References Cited

U.S. PATENT DOCUMENTS 6,619,871 B2 * 9/2003 Furukawa ..... B43K 5/18 401/224
6,659,671 B1 12/2003 Fukami et al.

FOREIGN PATENT DOCUMENTS

| | | | |
|---|---|---|---|
| CN | 101274565 | B | 4/2010 |
| CN | 102120394 | A | 7/2011 |
| CN | 201951013 | U | 8/2011 |
| CN | 103465684 | A | 12/2013 |
| CN | 105415923 | A | 3/2016 |
| CN | 106985572 | A | 7/2017 |

* cited by examiner

LIQUID INK WRITING INSTRUMENT

FIELD OF TECHNOLOGY

The present invention relates to a liquid ink writing instrument, which is a writing instrument in which an ink is directly stored in the cartridge, and can be used in the fields of stationery, medical service or industry, etc. It can realize the writing, marking and overlaying by means of a device containing and discharging various liquid inks.

BACKGROUND TECHNOLOGY

As a kind of writing instrument, marker pen, especially the one using various solvent inks with low surface tension, is a widely used overlaying and writing instrument. Due to the low surface tension of the ink, it is prone to problems such as ink leakage, so the marker pen most uses the reservoir structure made of fiber, however such ink storage structure may have ink residue, and the ink consumption during writing is continuously decreased, resulting in inadequate stability in the writing process.

To solve the above problems, the patent CN01809151.2 discloses a writing instrument in which ink is stored in a cartridge partitioned by multiple walls, there are intercommunicating pores on each wall to retain the ink under the action of capillary force, and air-liquid exchange is achieved via the gap between the ink supplier and the wall.

Although the above patent can solve the problem of some reservoir writing instruments, since the gap between the ink supplier and the wall is actually filled with ink, in the writing process, since the ink in the cartridge is continuously absorbed into the ink supplier, and there will be two possibilities for the ink in the gap, absorbed into the ink supplier or remained in the gap, the change cannot be precisely controlled, the air-liquid exchange would be affected if the gap is slightly different during the actually manufactured. In addition, the physical and chemical indicators of ink also have a great influence on the air-liquid exchange, resulting in no guarantee of mass production stability.

In addition, the patent CN200480043409.6 discloses an ink supplier which stores ink by means of the partition wall projection being higher than the level of liquid stored in the said ink cartridge, and sets up an ink absorber at the tail of the ink supplier to provide the needed ink for writing.

In the above patent, since the partition wall is higher than the level of the ink in cartridge, the ink is less likely to leak, but the product must be laid horizontally and inverted, so that ink can infiltrate the ink supplier or the ink absorber at the tail. Therefore, there are major drawbacks in terms of ease of use.

The patent CN201310398639.5 discloses a liquid ink writing instrument which achieves air-liquid exchange by setting an air guiding device and an ink guiding device with connecting the said ink tube and the storage tube on the partition wall, and providing two solutions, one is a is similar to the patent CN01809151.2, the other is to realize by the separate air guide holes.

In the first solution of above patent, there are also two possibilities for the ink in the gap, which are absorbed into the ink supplier or remain in the gap, and the change cannot be accurately controlled; the problem of the second solution is also obvious, since the air guide hole is independent of the ink supplier, there is no direct connection between them, which easily causes an imbalance between the writing end and the intake end.

The patent CN201510887830.5 discloses a liquid ink partition, in which the ink storage structure formed between the outer circular wall and the bottom circular wall of the pen body is separated by the plurality of partition layers with at least one groove. The principle is to separate the ink in different compartments, to achieve ink discharge in the order of the compartments, and to improve the performance of leakage resistance.

The above patent also uses the gap between the ink supplier and the ink partition for air exchange. The ink supply and air exchange of the ink cartridge are realized by the same groove. Since the relatively independent passage cannot be available, the air exchange process is very complicated and difficult to control. In addition, the patent has the problem that it cannot be mass-produced in practice. The reason is that the volume occupied by the ink partition in the ink cartridge is large. If the ink partition is placed after the ink cartridge is filled first, the ink is prone to overflow and the air pressure in the ink cartridge is prone to rise. On the other hand, if the ink partition is placed first and then the ink cartridge is filled, the mass production cannot be achieved because the passage into each compartment is small and the filling time is too long.

The U.S. Pat. No. 6,659,671 discloses a liquid ink writing instrument which also achieves the air-liquid exchange by the gap between the ink supplier and the partition wall, resulting in difficult control of the process.

The patent CN200810097132.5 discloses a liquid ink writing instrument which realizes ink supply control in writing process by two independent air-ink guide tubes. Since two air-ink guide tubes independently adjust air inflow, there is a problem in the balance between them in use.

In summary, although various existing liquid ink writing tools can solve the shortcomings of some existing fiber reservoir writing tools, since in the above technical solutions, some use independent air guide passenger of the ink supplier, and some use the gaps of various shapes with the ink supplier to achieve air-liquid exchange, the precise control of the balance between ink and air pressure has not been achieved, so that various complicated and uncertain changes occur in the writing process, resulting in the system instability and lack of adaptability to ink.

SUMMARY OF THE INVENTION

The present invention provides a liquid ink writing instrument, which realizes precise adjustment of ink and air changes during writing by setting multiple air-liquid balancers, and continuously realizes dynamic balance between ink and air pressure through the action of the overflow groove during writing to ensure smooth and stable writing while ensuring that ink leakage is less likely to occur during writing and storage.

The specific implementation adopted by the present invention is as follows:

A liquid ink writing instrument comprising:

A pen body for containing ink and constituting the principal part of the writing instrument;

A writing element mounted on the head of the pen body;

An ink absorber mounted at the rear end of the writing element;

A fiber ink feeder mounted in the pen body penetrates through the ink absorbing body, the front end of which is in contact with the writing element, and the rear end of which is connected with the ink cartridge formed by the inner cavity of the pen body; it is characterized by: At least one air-liquid balancer is set in the recited pen body along the axial direction, the air-liquid balancer is installed between the recited fiber ink feeder and the pen body, a outer circumferential surface of the air-liquid balancer is provided with one or more air-liquid exchange grooves penetrating the outer circumferential surface thereof and having a capillary attraction effect on the ink; there is an overflow groove on the radial surface of the air-liquid balancer, one end of the overflow groove is in contact with the fiber ink feeder, and the other end is connected with the air-liquid exchange groove; a transition fit or an interference fit is adopted between the outer circumferential surface of the fiber ink feeder and the inner wall of the air-liquid balancer. Due to the low surface tension of ink, the marker pen is prone to the risk of ink leakage, so when the temperature rises or the internal pressure increases, too much ink flows along the fiber ink feeder towards the writing element end, and the fiber relay core is supersaturated. When the ink flows to the position of air-liquid balancer overflow groove, since the fiber relay core is in close contact with the overflow groove, there is capillary attraction force from the saturated regions to the unsaturated region, so the super-saturated ink will flow from the overflow groove into the air-liquid balancer to achieve a buffering effect.

In the writing process, as the ink absorbed in the fiber relay core is continuously consumed, the volume of air in the ink cartridge is continuously increased. At this time, the external air pressure will have a tendency to be greater than the internal ink cartridge pressure, especially in quick writing, the ink consumption during writing is greater than the speed at which the fiber relay core absorbs ink from the ink cartridge, and the fiber relay core is under-saturated. Since the fiber relay core is in close contact with the overflow groove, there is capillary attraction from the saturated region to the unsaturated region. At this time, the ink moves from the air-liquid balancer overflow groove to the fiber relay core, and synchronously the ink in the air-liquid exchange groove reduces the gap, and the air is replenished from the outside to the ink cartridge along the air-liquid exchange groove to achieve a new balance between writing and consumption.

According to different ink charging requirements, multiple air-liquid balancers can be set. Synchronously, air-liquid balancers can also be equipped with multiple air-liquid exchange grooves. As a necessary condition, each air-liquid exchange groove must run through the overflow groove to connect to the relay core to ensure the realization of the balance.

One end of the overflow groove must be in close contact with the fiber relay core by a clearance-free fit or an interference fit, and the other end thereof needs to communicate with the air-liquid exchange groove, thereby functioning as a connection and a bond between them. Preferably, the air-liquid balancer can be formed by an injection molding process using various plastic polymer materials, such as ABS, PP, PE, PMMA, PA66 and the like.

Preferably, the air-liquid exchange groove width A of the air-liquid balancer is 0.05 mm to 0.40 mm.

According to the surface tension of the ink and the pressure distribution in the ink cartridge, the exchange groove width of the air-liquid balancer can be calculated by the Laplace liquid surface tension equation to ensure that the ink flow and air exchange in the gas-liquid exchange groove under conditions that produce sufficient capillary forces. After calculation and actual optimization of different ink tests, it is preferred that the exchange groove width A is 0.05 mm to 0.40 mm.

Preferably, the overflow groove width B of the air-liquid balancer is less than or equal to the air-liquid exchange groove width A.

Due to the balance function of the overflow groove, the width of the overflow groove generally need to be less than or equal to the width of the air-liquid exchange groove.

Preferably, an interference-fitted step limiting is adopted between the outer circumferential surface of the air-liquid balancer far from the writing element end and the inner wall of the pen body.

The outer circumferential surface of the air-liquid balancer need to be interference-fitted with the pen body to ensure that the air-liquid exchange groove is communicated with the ink cartridge, and other circumferential surfaces thereof far from the writing element end are also completely sealed with axial limiting to prevent endplay. Make sure that air-liquid exchange occurs in the air-liquid exchange groove.

Preferably, a plurality of circumferential slotted holes can be made on the outer circumferential surface of the air-liquid balancer to form an ink buffer slot, and the ink buffer slot is communicated with the air-liquid exchange groove, it is preferred that the clearance axial width C of the slotted holes is 0.05 mm to 0.50 mm.

When the internal air pressure increases or the internal temperature rises, too much ink flows to the air-liquid balancer to achieve the buffering effect. In order to strengthen this buffering effect, it should be ensured that more ink could be contained in the air-liquid balancer. A plurality of circumferential slotted holes are provided on the outer circumferential surface of the air-liquid balancer to form an ink buffer slot, and when the exchange groove can barely contain more ink, the ink enters the ink buffer slot for storage. If more ink is consumed during the writing process, the ink stored in the ink buffer slot will gradually enter the air-liquid exchange groove and the overflow groove, and finally enter the fiber ink feeder for writing. Also calculated according to the Laplace liquid surface tension equation and actual optimization of different ink tests, it is preferred that the clearance axial width C of the slotted holes is 0.05 mm to 0.50 mm.

Preferably, the overflow groove is disposed on an end surface or in the mid-position of the air-liquid balancer and through the inner wall.

After the exchange groove, the overflow groove and the circumference slotted holes are provided, the air-liquid balancer constitutes a capillary action system, so it can also function as an ink absorber. It is preferred that the air-liquid balancer can be optimally selected as the ink absorber.

Preferably, the ink absorber adopts the porous cotton-core ink storage structure made of fiber to absorb the ink. The ink absorber can be made from various fibers such as polyester fiber, polypropylene fiber, and nylon fiber by winding and bunching, and the clearance between the fibers can generate a capillary force to realize the function of storing the ink.

Preferably, when there is a plurality of air-liquid balancers, the volume relationship between two consecutive ink cartridges partitioned by the independent air-liquid balancers is: Along the writing element end to the farthest end, the volume of ink cartridge at the far end is greater than or equal to that of ink cartridge at the near end.

Since a plurality of air-liquid balancers can buffer the overflow of excess ink step by step, in order to better prevent the risk of ink leakage, it is preferred that the volume of the partitioned ink cartridge closest to the writing element is the smallest and gradually increases.

Preferably, the fiber ink feeder is provided with an axial limiting step along the axis of the air-liquid balancer at the farthest end of the writing element, and the circumferential surface of the step is made with slotted holes to realize the contact of the ink in the ink cartridge with the ink feeder.

Preferably, the air-liquid exchange groove of air-liquid balancer is communicated with the external environment through the air passage on the inner wall of the pen body starting from the writing element end.

Through the air passage, the air can be replenished into the exchange groove of air-liquid balancer in time to ensure the smooth realization of air-liquid exchange.

Through the above technical solutions, the batch assembly process that can be implemented is as follows: the air-liquid balance is assembled one by one in the pen body; after the air-liquid balancer is assembled in place, the filling nozzle with a diameter smaller than that of the fiber ink feeder for injection filling, and move the filling nozzle upwards gradually to fill each ink cartridge; after the filling is completed, the fiber ink feeder, the ink absorber and the writing element are assembled, and the sealing cap is covered to form the final product.

Beneficial Effects of the Present Invention

The present invention not only ensures the relative independence of the air guide structure provided on the outer circumferential surface of the air-liquid balancer, but also realizes the ink exchange with the fiber ink feeder through the overflow groove, thereby ensuring the balance between each other. And through the setting of different functional zones of the air-liquid balancer, the micro-instability of air-liquid exchange during writing and the external environment change is improved.

The present invention can set the air-liquid exchange groove and the ink buffer slot and overflow groove of different widths according to different surface tension and viscosity conditions of the ink, and can adapt and control the balance and the outflow of various inks through the change of the width, creating favorable conditions for the achievability of mass production.

The present invention can be applied to various writing instruments using low-viscosity ink, such as roller-tip ballpoint pen, permanent marker pen, whiteboard pen, industrial marker pen, medical marker pen, etc., and can further extend to various overlaying tools due to its stable characteristics, such as make-up overlaying tools and painting materials.

BRIEF DESCRIPTION OF THE DRAWINGS

The figures which are incorporated in the present application are intended to provide a further understanding of the present application, and the exemplary example of the present application and the description thereof are intended to explain this application and not to be construed as a limitation thereof.

In the figure: 1 is writing element, 2 is ink absorber, 3 is fiber ink feeder, 4 is pen body, 5 is air-liquid balancer, 6 is ink cartridge VI, 7 is ink cartridge VII, 8 is ink cartridge VIII, 9 is air-liquid exchange groove, 10 is overflow groove, 11 is ink buffer slot, 12 is air-liquid exchange groove, 13 is ink absorber, 14 is limiting step, 15 is slotted hole, and 16 is air passage.

DETAILED DESCRIPTION OF THE EMBODIMENTS

It should be noted that the following detailed descriptions are all exemplary and intend to provide a further description of the present application. All technical and scientific terms used herein have the same meaning as commonly understood by those of ordinary skill in the art of the present application, unless otherwise specified.

It should be noted that the terms used herein are for the purpose of describing specific embodiments only, and are not intended to limit the exemplary embodiments based on the present application. As used herein, the singular forms are also intended to include the plural, unless otherwise indicated in the context clearly, and it is also should be understood that when the terms "include" and/or "including" are used in the specification, they refer to the features, steps, operations, devices, components, and/or combinations thereof.

The present invention will be described in detail below with reference to the embodiment example figures:

Embodiment 1

Figure 1:
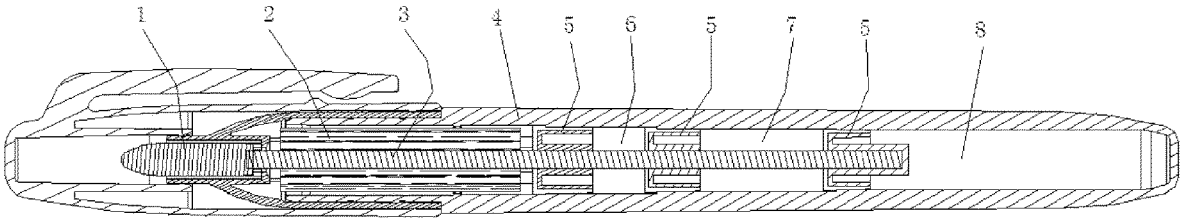
FIG. 1 is a first embodiment of the present invention.
Figure 2:
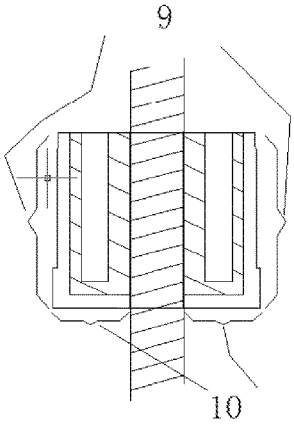
FIG. 2 is a partial view showing the cooperation of the air-liquid balancer and the fiber ink feeder of the present invention.

Refer to FIG. 1 for details. It relates to a water-based marker pen, with ink surface tension of 30 to 35 mN/m and charging capacity of 3.5 g, which is used for writing, marking and painting. The ink absorber is made of polyester fiber cotton, and the porosity of about 80%. The specific structure is as follows:

said marker pen comprising: a pen body 4 for containing ink and constituting the principal part of the writing instrument; a writing element 1 mounted on the head of the pen body; an ink absorber 2 mounted on the back end of the writing element; a fiber ink feeder 3 mounted in the pen body penetrates through the ink absorber, the front end of which is in contact with the writing element, and the rear end of which is communicated with the ink cartridge formed by the inner cavity of the pen body; it is characterized in that there is at least one air-liquid balancer 5 provided in the pen body along the axial direction, the air-liquid balancer 5 is mounted in the annular space between the fiber ink feeder and the pen body, there is one or more air-liquid exchange grooves 9 penetrating the outer circumferential surface thereof and having a capillary attraction effect on the ink; there is an overflow groove 10 on a radial surface of the air-liquid balancer, one end of which is contacted with the ink feeder, and the other end of which is communicated with the air-liquid exchange groove 9; a clearance-free fit or an interference fit is adopted between the outer circumferential surface of the fiber ink feeder and the inner wall of the air-liquid balancer.

Figure 3:
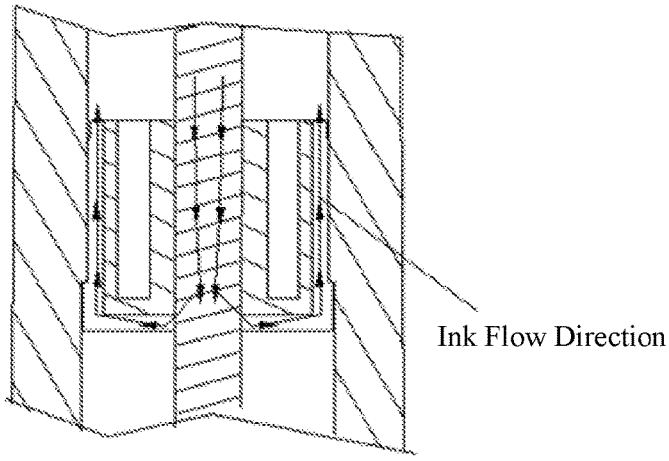
FIG. 3 is a schematic view showing the movement of the ink in the air-liquid balancer when the temperature rises or the internal pressure increases.

Due to the low surface tension of ink, the marker pen is prone to the risk of ink leakage, so when the temperature rises or the internal pressure increases, too much ink flows along the fiber ink feeder towards the writing element end, and the fiber relay core is supersaturated. When the ink flows to the position of air-liquid balancer overflow groove, since the fiber relay core is in close contact with the overflow groove, there is capillary attraction force from the saturated regions to the unsaturated region, so the supersaturated ink will flow from the overflow groove into the air-liquid balancer to achieve a buffering effect. Refer to FIG. 3 for the ink flow direction.

Figure 4:
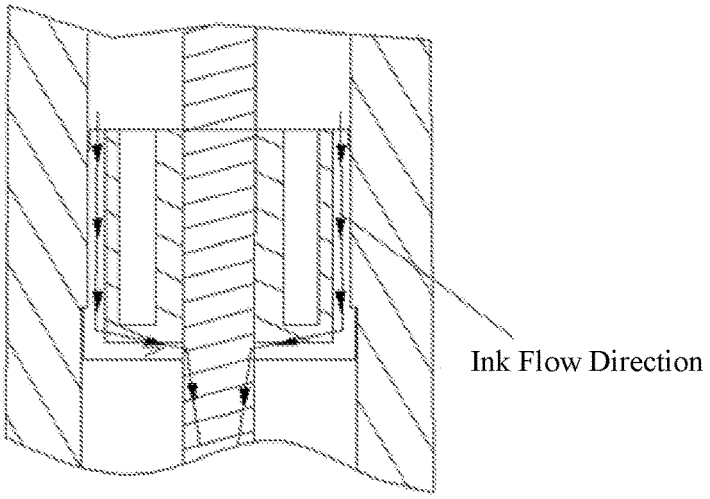
FIG. 4 is a schematic view showing the movement of ink in the air-liquid balancer during writing of the present invention.

In the writing process, as the ink absorbed in the fiber relay core is continuously consumed, the volume of air in the ink cartridge is continuously increased. At this time, the external air pressure will have a tendency to be greater than the internal ink cartridge pressure, especially when writing quickly, the ink consumption during writing is greater than the speed at which the fiber relay core absorbs ink from the ink cartridge, and the fiber relay core is under-saturated. Since the fiber relay core is in close contact with the overflow groove, there is capillary attraction from the saturated regions to the unsaturated region. At this time, the ink moves from the air-liquid balancer overflow groove to the fiber relay core, and synchronously the ink in the air-liquid exchange groove reduces the gap, and the air is replenished from the outside to the ink cartridge along the air-liquid exchange groove to achieve a new balance between writing and consumption. Refer to FIG. 4 for the ink flow direction.

According to different ink charging requirements, multiple air-liquid balancers 5 can be set. Synchronously, air-liquid balancers 5 can also be equipped with multiple air-liquid exchange grooves. As a necessary condition, each air-liquid exchange groove must run through the overflow groove to connect to the relay core to ensure the realization of the balance.

In FIG. 1, three air-liquid balancers 5 are provided. The three air-liquid balancers 5 partition the interior of the pen body into three ink cartridges, which are ink cartridge VI 6, ink cartridge VII 7, and ink cartridge VIII 8. Since the three air-liquid balancers 5 can buffer the overflow of excess ink step by step, in order to better prevent the risk of ink leakage, it is preferred that the volume of the partitioned ink cartridge closest to the writing element is the smallest and increases gradually. Assume that the volume of the ink cartridge VI 6 closest to the writing element is VI, and the other two ink cartridges are VII and VIII, then VII is greater than or equal to VI but less than or equal to VIII.

One end of the overflow groove must be in close contact with the fiber relay core by clearance-free fit or an interference fit, and the other end thereof needs to communicate with the air-liquid exchange groove, thereby functioning as a connection and a bond between them. Preferably, the air-liquid balancer 5 can be formed by an injection molding process using various plastic polymer materials, such as ABS, PP, PE, PMMA, PA66 and the like.

Figure 5:
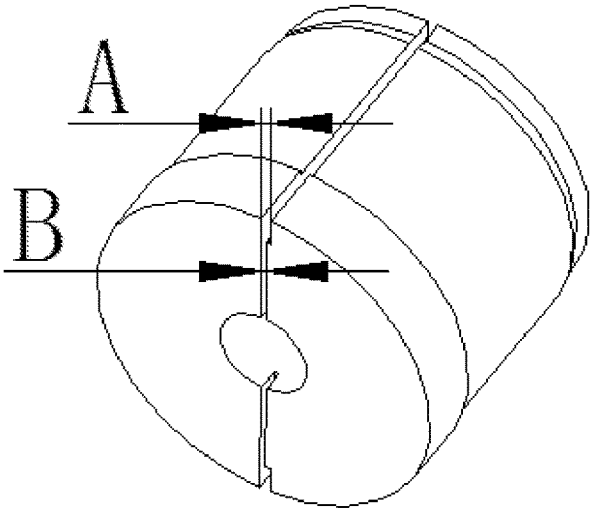
FIG. 5, FIG. 6, and FIG. 7 are the cross-sectional view and perspective view of an air-liquid balancer of the present invention.

Preferably, the overflow groove width B of the air-liquid balancer 5 is less than or equal to the exchange groove width A. The position of overflow groove is shown in FIG. 5, FIG. 6, and FIG. 7.

Due to the balance function of the overflow groove, the width of the overflow groove generally need to be less than or equal to the width of the air-liquid exchange groove.

Preferably, an interference-fitted step limiting is adopted between the outer circumferential surface of the air-liquid balancer 5 far from the writing element end and the inner wall of the pen body.

Figure 6:
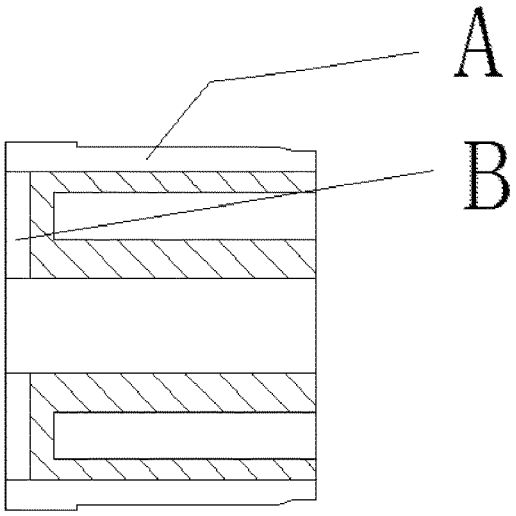
Figure 7:
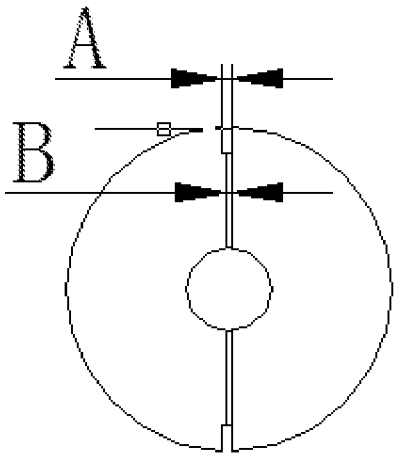
Figure 8:
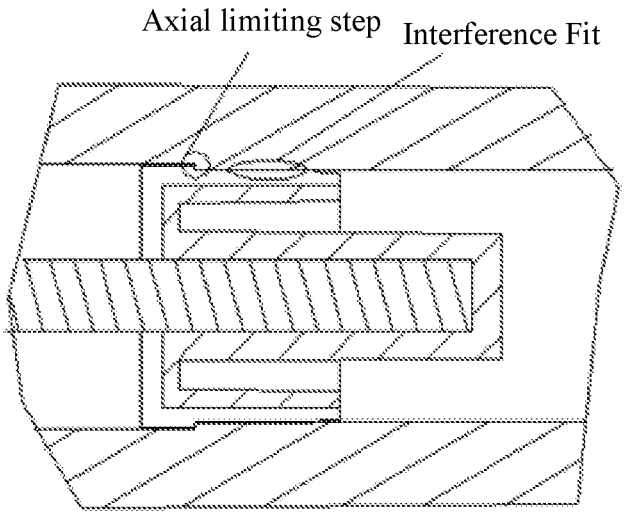
FIG. 8 is a cross-sectional view of the fit between the air-liquid balancer and the pen body of the present invention.
Figure 9:
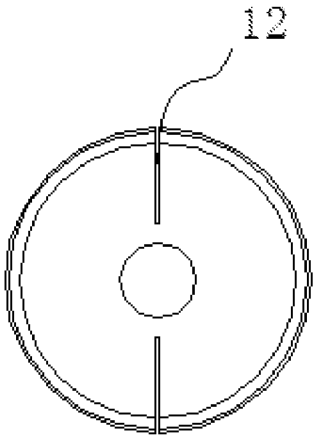
FIG. 9, FIG. 10, FIG. 11, and FIG. 12 are the cross-sectional view and perspective view of the air-liquid balancer with an ink buffer slot added of the present invention.
Figure 10:
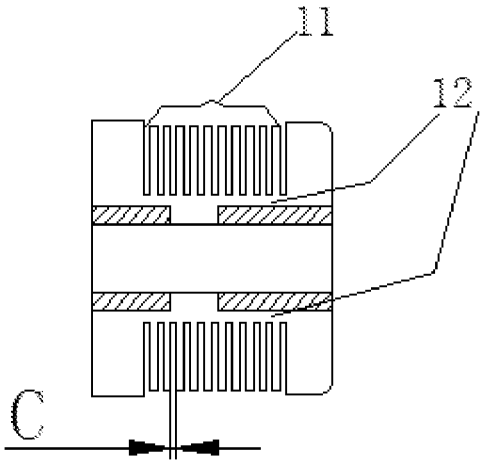
Figure 11:
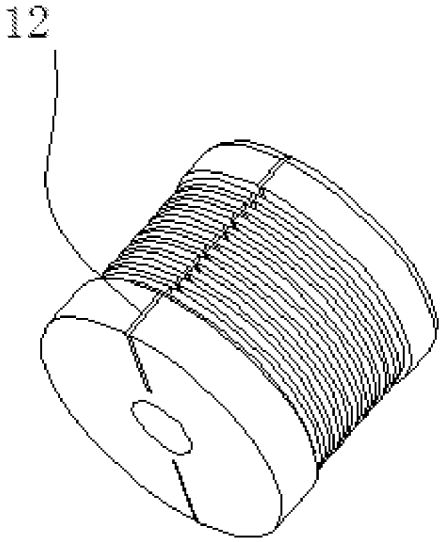
Figure 12:
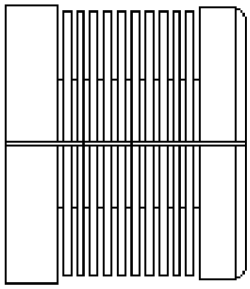

The outer circumferential surface of the air-liquid balancer 5 needs to be interference-fitted with the pen body to ensure that the air-liquid exchange groove is communicated with the ink cartridge, and other circumferential surfaces thereof from the writing element end are also completely sealed with axial limiting to prevent endplay, as shown in FIG. 6. Make sure that air-liquid exchange occurs in the air-liquid exchange groove.

Further preferably, a plurality of circumferential slotted holes can be made on the outer circumferential surface of the air-liquid balancer shown in FIG. 5, FIG. 6 and FIG. 7 to form an ink buffer slot, and the ink buffer slot is communicated with the air-liquid exchange groove, it is preferred that the clearance axial width C of the slotted holes is 0.05 mm to 0.50 mm.

After the exchange groove, the overflow groove and the circumference slotted holes are provided, the air-liquid balancer constitutes a capillary action system, so it can also function as an ink absorber. It is preferred that the air-liquid balancer can be optimally selected as the ink absorber.

When the internal air pressure increases or the internal temperature rises, too much ink flows to the air-liquid balancer to achieve the buffering effect. In order to strengthen this buffering effect, it should be ensured that more ink could be contained in the air-liquid balancer. A plurality of circumferential slotted holes are provided on the outer circumferential surface of the air-liquid balancer to form an ink buffer slot, and when the exchange groove can barely contain more ink, the ink enters the ink buffer slot for storage. If more ink is consumed during the writing process, the ink stored in the ink buffer slot will gradually enter the air-liquid exchange groove and the overflow groove, and finally enter the fiber ink feeder for writing. Also calculated according to the Laplace liquid surface tension equation and actual optimization of different ink tests, it is preferred that the clearance axial width C of the slotted hole is 0.05 mm to 0.50 mm.

Preferably, the ink absorber 2 adopts the porous cotton-core ink storage structure made of fiber to absorb the ink. The ink absorber can be made from various fibers such as polyester fiber, polypropylene fiber, and nylon fiber by winding and bunching, and the clearance between the fibers can generate a capillary force to realize the function of storing the ink.

Preferably, the ink cartridges are partitioned by a plurality of independent air-liquid balancers 5, wherein for two consecutive ink cartridges along the writing element end to the farthest end, the volume of ink cartridge at the far end is greater than or equal to that of ink cartridge at the near end.

Preferably, the fiber ink feeder is provided with an axial limiting step along the axis of the air-liquid balancer at the farthest end of the writing element, and the circumferential surface of the step is made with slotted holes to realize the contact of the ink in the ink cartridge with the ink feeder.

Through the air passage, the air can be replenished into the exchange groove of air-liquid balancer in time to ensure the smooth realization of air-liquid exchange.

Figure 18:
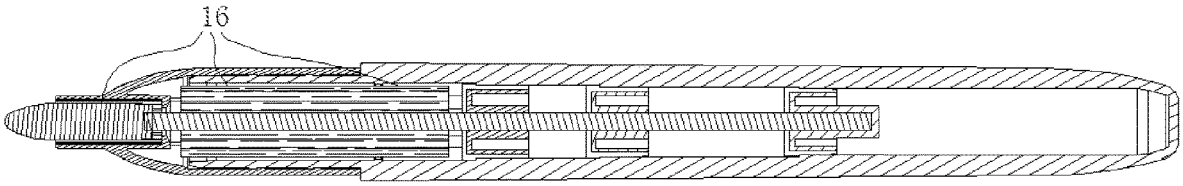
FIG. 18 is a schematic view of the internal air passage of the pen body of the present invention.

Preferably, the air-liquid exchange groove of air-liquid balancer is communicated with the external environment through the air passage on the inner wall of the pen body starting from the writing element end, as shown in FIG. 18.

Through the above technical solutions, the batch assembly process that can be implemented is as follows: the air-liquid balance is assembled one by one in the pen body; after the air-liquid balancer is assembled in place, the filling nozzle with a diameter smaller than that of the fiber ink feeder for injection filling, and move the filling nozzle upwards gradually to fill each ink cartridge; after the filling is completed, assemble the fiber ink feeder, the ink absorber and the writing element, and the sealing cap is covered to form the final product.

The technical solution for selecting the width of air-liquid exchange groove of air-liquid balancer 5 is as follows:

ABS material with better hydrophilic is used in air-liquid balancer 5, and chemical surface treatment has been performed to improve hydrophilic. The air-liquid balancer overflow groove width is selected to be the same as that of air-liquid balance groove.

Selection of test plan: immerse one end of each air-liquid balancer having different exchange groove width that has been subjected to the same chemical surface treatment vertically into the ink to test the inking speed of the air-liquid balancer under the same ink tension. Details are as follows:

| | Test Condition Width of Air-liquid Exchange Groove (mm) | | | |
|---|---|---|---|---|
| | 0.05 | 0.15 | 0.25 | 0.35 |
| Inking Condition | The whole length of exchange groove is filled with ink | The whole length of exchange groove is filled with ink | About ⅔ of the total length of exchange groove is filled with ink | About ¼ of the total length of exchange groove is filled with ink |
| Average Inking Speed (second) | 23 | 45 | No statistics necessary due to incomplete filling | No statistics necessary due to incomplete filling |

According to the above test results, the air-liquid balancers having groove widths of respectively 0.05 mm and 0.15 mm was selected for further design.

According to the charging capacity, three air-liquid balancers were selected to partition the ink cartridge into three parts, in which the charging capacity of ink cartridge closet to the writing element is 0.5 g, that of ink cartridge closer to the writing element is 1.5 g, and that of ink cartridge farthest to the wring element is 2 g.

Different pen bodies assembled respectively with the air-liquid balancers having groove width of 0.05 mm and 0.15 mm and other parts were used to carry out the following tests:

Writing Test:

Based on writing pressure of 100 g, ISO14145 writing paper, writing angle of 65 degrees, and writing speed of 4.5 m/min, a writing machine was used to test the writing conditions in two cases, the results are as follows:

| | Test Condition Width of Air-liquid Exchange Groove (mm) | |
|---|---|---|
| | 0.05 | 0.15 |
| Writing Condition | The writing lines are light in color and whole process of writing is completed | The writing lines are clear and whole process of writing is completed |
| Average Ink Consumption Rate | 94.5% | 95.7% |
| Average Ink Consumption (mg/m) | 1.85 | 2.35 |

Constant Temperature Test:

Based on the environmental chamber, the 3-month constant temperature test was carried out by three means of respectively laying the pen flat, pen tip facing up and pen tip facing down, with the pen cap covered, under the temperature of 40° C. and relative humidity of 40 to 70% to compare the ink leakage resistance. The test result is as follows:

| Testing of ink leakage % Width of Air-liquid Exchange Groove (mm) | 0.05 | 0.15 |
|---|---|---|
| Ink leakage % with pen tip facing up | 0 | 0 |
| Ink leakage % with pen laid flat | 0 | 0 |
| Ink leakage % with pen tip facing down | 0 | 0 |

Based on the above test results and manufacturing feasibility, an air-liquid balancer having an air-liquid exchange groove width of 0.15 mm was selected for the implementation of the product technical solution.

Embodiment 2

Figure 15:
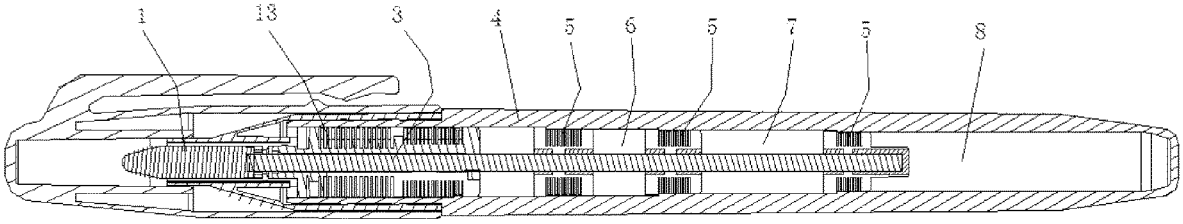
FIG. 15 is the second embodiment of the present invention.

Refer to FIG. 15 for details.

It relates to an alcohol-based permanent marker pen, with ink surface tension of 20 to 25 mN/m and charging capacity of 3 g, which is used for marking. Ink absorber is design with the same structure as the air-liquid balancer. Said marker pen as shown in FIG. 15 comprising: a pen body 4 containing ink and constituting the principal part of the writing instrument; a writing element 1 mounted on the head of the pen body; an ink absorber 2 mounted on the back end of the writing element; a fiber ink feeder 3 mounted in the pen body penetrates through said ink absorber, the front end of which is in contact with the writing element, and the rear end of which is communicated with the ink cartridge formed by the inner cavity of the pen body; and is characterized in that there is at least one air-liquid balancer 5 provided in said pen body along the axial direction, the air-liquid balancer is mounted in the annular space between the fiber ink feeder and the pen body and organized in the structure as shown in FIG. 9, FIG. 10, FIG. 11 and FIG. 12, and there is a transverse overflow groove in the middle of the interior of the air-liquid balancer, the overflow groove is connected with two longitudinal air-liquid exchange grooves, and the air-liquid exchange grooves are further connected to the ink buffer slot formed by multiple circumferential slotted holes on the outer circumferential surface of the air-liquid balancer. On end of the overflow groove 10 is contacted with fiber ink feeder, the other end is connected to said air-liquid exchange groove 9; a clearance-free fit or an interference fit is adopted between the outer circumferential surface of the fiber ink feeder and the inner wall of the air-liquid balancer.

Figure 13:
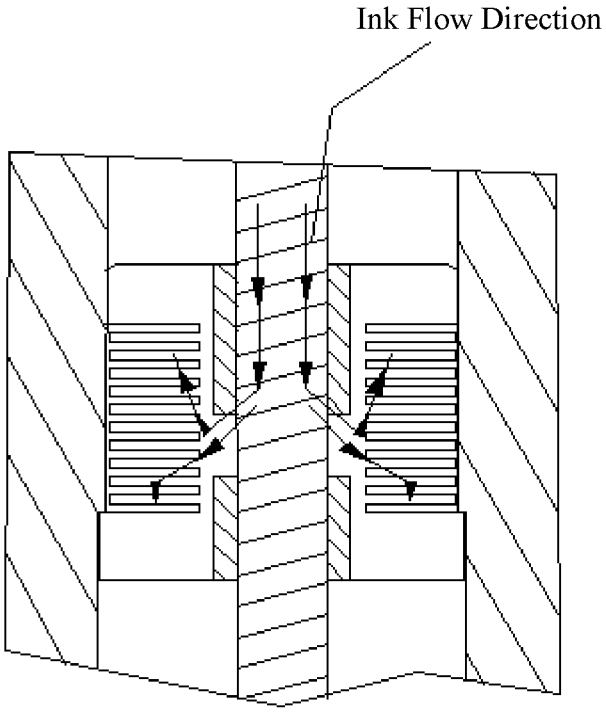
FIG. 13 is the schematic view showing the movement of the ink in the air-liquid balancer with an ink buffer slot added when the temperature rises or the internal pressure increases.
Figure 14:
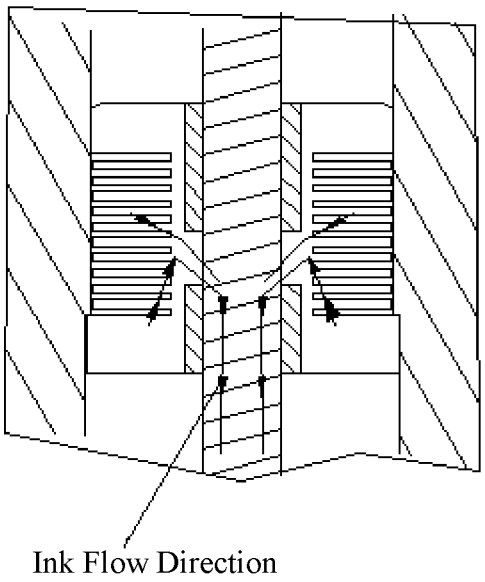
FIG. 14 is the schematic view showing the movement of the ink in the air-liquid balancer with an ink buffer slot added during writing of the present invention.

Specifically, the ink flow direction in the air-liquid balancer is shown in FIG. 13 and FIG. 14.

After the exchange groove, the overflow groove and the circumference slotted holes are provided, the air-liquid balancer constitutes a capillary action system, so it can also function as an ink absorber. It is preferred that the air-liquid balancer can be optimally selected as the ink absorber.

Preferably, the ink absorber 13 adopts the porous cotton-core ink storage structure made of fiber to absorb the ink. The ink absorber can be made from various fibers such as polyester fiber, polypropylene fiber, and nylon fiber by winding and bunching, and the clearance between the fibers can generate a capillary force to realize the function of storing the ink. Preferably, the ink cartridges are partitioned by a plurality of independent air-liquid balancers, wherein for two consecutive ink cartridges along the writing element end to the farthest end, the volume of ink cartridge at the far end is greater than or equal to that of ink cartridge at the near end.

Since a plurality of air-liquid balancers can buffer the overflow of excess ink step by step, in order to better prevent the risk of ink leakage, it is preferred that the volume of the partitioned ink cartridge closest to the writing element is the smallest and increases gradually. Taking FIG. 15 as an example, assume that the volume of ink cartridge closest to the writing element is V1, and that of other two ink cartridges are V2 and V3, where V2 is greater than or equal to V1 but less than or equal to V3.

Figure 16:
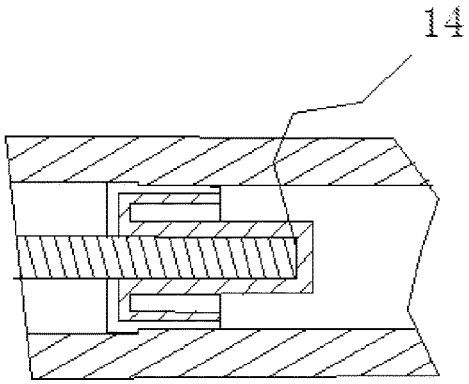
FIG. 16 and FIG. 17 are cross-sectional views of the fit between the fiber ink feeder tail and the air-liquid balancer of the present invention.
Figure 17:
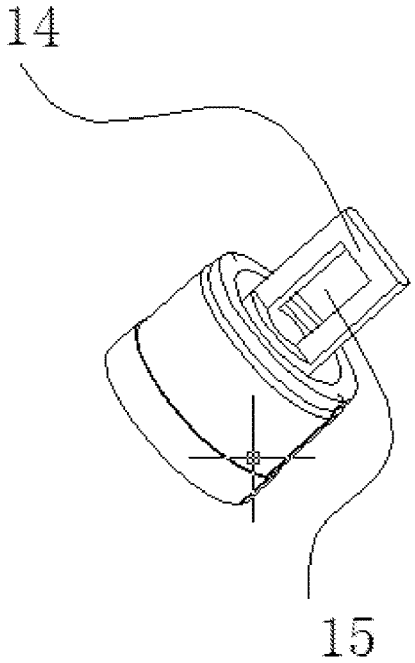

Preferably, the fiber ink feeder is provided with an axial limiting step 14 along the axis of the air-liquid balancer at the farthest end of the writing element, and the circumferential surface of the step is made with slotted holes 15 to realize the contact of the ink in the ink cartridge with the ink feeder. Refer to FIG. 16 and FIG. 17 for details.

Through the air passage, the air can be replenished into the exchange groove of air-liquid balancer in time to ensure the smooth realization of air-liquid exchange.

The technical solution for selecting the width of the air-liquid exchange groove of the air-liquid balancer should be additionally described, as follows:

PP material with better chemical resistance is used in air-liquid balancer, and chemical surface treatment is further performed to improve hydrophilic. In order to improve the buffering capacity of ink, the air-liquid balancer having two air-liquid exchange grooves, two corresponding overflow grooves and a plurality of ink buffer slots on the outer circumferential surface is selected, in which the width of overflow groove is the same as that of air-liquid balancer groove, and the width of each ink buffer slot is 0.20 mm.

Selection of test plan: immerse one end of each air-liquid balancer having different exchange groove width that has been subjected to the same chemical surface treatment vertically into the ink to test the inking speed of the air-liquid balancer under the same ink tension. Details are as follows:

| | Test Condition Width of Air-liquid exchange groove (mm) | | | |
|---|---|---|---|---|
| | 0.05 | 0.10 | 0.15 | 0.20 |
| Inking Condition | The whole lengths of the exchange groove and the ink buffer slot are completely filled with ink | The whole lengths of the exchange groove and the ink buffer slot are completely filled with ink | About ⅓ of the total length of exchange groove is filled with ink, and about 80% to 90% of ink is filled in the ink buffer slot adjacent to the exchange groove | About ⅓ of the total length of exchange groove is filled with ink, and about 70% to 90% of ink is filled in the ink buffer slot adjacent to the exchange groove |
| Average Inking Speed (second) | 34 | 57 | No statistics necessary due to incomplete filling | No statistics necessary due to incomplete filling |

According to the above test results, the air-liquid balancers having groove widths of respectively 0.05 mm and 0.10 mm were selected for further design.

According to the charging capacity, three air-liquid balancers were selected to partition the ink cartridge into three parts, in which the charging capacity of ink cartridge closet to the writing element is 0.5 g, that of ink cartridge closer to the writing element is 1 g, and that of ink cartridge farthest to the wring element is 1.5 g.

Different pen bodies assembled respectively with the air-liquid balancers having groove width of 0.05 mm and 0.10 mm and other parts were used to carry out the following tests:

Writing Test:

Based on writing pressure of 100 g, PE film, writing angle of 65 degrees, and writing speed of 4.5 m/min, a writing machine was used to test the writing conditions in two cases, the results are as follows:

| | Test Condition Width of Air-liquid Exchange Groove (mm) | |
|---|---|---|
| | 0.05 | 0.10 |
| Writing Condition | The writing lines are clear and whole process of writing is completed | The writing lines are clear and whole process of writing is completed |
| Average Ink Consumption Rate | 93.9% | 94.2% |
| Average Ink Consumption (mg/m) | 2.16 | 2.73 |

Constant Temperature Test:

Based on the environmental chamber, the 3-month constant temperature test was carried out by three means of respectively laying the pen flat, pen tip facing up and pen tip facing down, with the pen cap covered, under the temperature of 40° C. and relative humidity of 40 to 70% to compare the ink leakage resistance. The test result is as follows:

| | Testing of ink leakage % Width of Air-liquid Exchange Groove (mm) | |
|---|---|---|
| | 0.05 | 0.10 |
| Ink leakage % with pen tip facing up | 0 | 0 |
| Ink leakage % with pen laid flat | 0.5% | 0 |
| Ink leakage % with pen tip facing down | 1.5% | 0 |

Based on the above test results and manufacturing feasibility, an air-liquid balancer having an air-liquid exchange groove width of 0.10 mm was selected for the implementation of the product technical solution.

Similarly, an air-liquid balancer having the same air-liquid exchange groove width was selected as the ink absorber.

Figure 19:
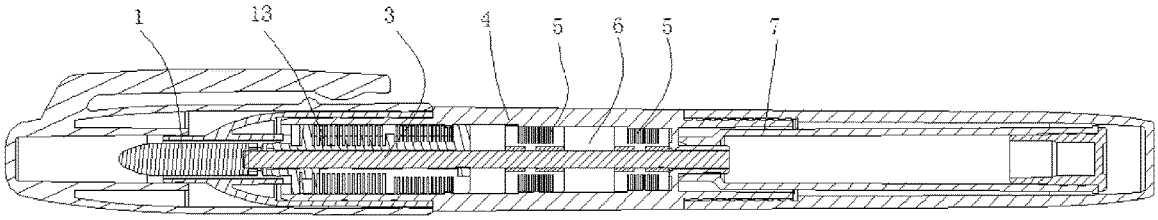
FIG. 19 is third embodiment of the present invention.

Embodiment 3: Refer to FIG. 19 for Details

It relates to a water-based marker pen, with ink surface tension of 30 to 35 mN/m and ink bag charging capacity of 2.5 g, which is used for wiring, marking and painting. As shown in FIG. 19, both the tail-end fixation of fiber ink feeder and the structure of pen body are changed, and the pen body 4 is a split structure where the ink bag is plug-in mounted; the tail end of fiber ink feeder is fixed by a separate ink bag fixed leg, and when the ink bag is mounted on the fixed leg, the ink tank is formed; the rest of the structure is as same as Example 2; of course, the air-liquid balancer in this structure can also select the structure shown in FIG. 5, FIG. 6, and FIG. 7.

In this structure, two air-liquid balancers are used for step-by-step buffering. In addition, the front-end ink absorber 13 uses similar design structure with air-liquid balancer, and an annular groove is provided thereon.

The above descriptions of the specific embodiments of the present invention have been described in connection with the drawings, but not intend to limit the scope of the invention. It should be understood by the person skilled in the art that various modifications or variations that can be made by those skilled in the art on the basis of the technical solutions of the present invention without creative efforts are still within the scope of protection of the present invention.

The invention claimed is:

1. A liquid ink writing instrument comprising: a pen body for containing ink and constituting a principal part of the writing instrument;

a writing element mounted on a head of the pen body;

an ink absorber mounted on a rear end of the writing element;

a fiber ink feeder mounted in the pen body penetrates through said ink absorber, a front end of which is contacted with the writing element, and a rear end is communicated with an ink cartridge formed by an inner cavity of the pen body; wherein, at least one air-liquid balancer is set in the pen body along an axial direction, the air-liquid balancer is installed between the fiber ink feeder and the pen body; there is one or more air-liquid exchange grooves penetrating an outer circumferential surface of the air-liquid balancer thereof and having a capillary attraction effect on the ink; there is an overflow groove on a radial surface of the air-liquid balancer, one end of which is in contact with the fiber ink feeder, and the other end of which is communicated with the air-liquid exchange groove; an interference fit is provided between an outer circumferential surface of the fiber ink feeder and an inner wall of the air-liquid balancer.

2. The liquid ink writing instrument according to claim 1, wherein an air-liquid exchange groove width A of the air-liquid balancer is 0.05 mm to 0.40 mm.

3. The liquid ink writing instrument according to claim 2, wherein there is an overflow groove penetrating the inner wall provided on a surface or in a mid-position of the air-liquid balancer.

4. The liquid ink writing instrument according to claim 1, wherein an overflow groove width B of the air-liquid balancer is less than or equal to an air-liquid exchange groove width A.

5. The liquid ink writing instrument according to claim 4, wherein there is an overflow groove penetrating the inner wall provided on a surface or in a mid-position of the air-liquid balancer.

6. The liquid ink writing instrument according to claim 1, wherein an interference-fitted step limiting relationship is provided between the outer circumferential surface of the air-liquid balancer far from the writing element end and an inner wall of the pen body.

7. The liquid ink writing instrument according to claim 6, wherein there is an overflow groove penetrating the inner wall provided on a surface or in a mid-position of the air-liquid balancer.

8. The liquid ink writing instrument according to claim 1, wherein there is an ink buffer slot formed by a plurality of circumferential slotted holes on the outer circumferential surface of the air-liquid balancer, with each slotted hole being connected to the air-liquid exchange groove.

9. The liquid ink writing instrument according to claim 8, wherein there is an overflow groove penetrating the inner wall provided on a surface or in a mid-position of the air-liquid balancer.

10. The liquid ink writing instrument according to claim 1, wherein there is an overflow groove penetrating the inner wall provided on a surface or in a mid-position of the air-liquid balancer.

11. The liquid ink writing instrument according to claim 1, wherein the ink absorber provides a porous fiber reservoir structure to absorb the ink.

12. The liquid ink writing instrument according to claim 1, wherein when there is a plurality of air-liquid balancers, the volume relationship between two consecutive ink cartridges partitioned by the independent air-liquid balancers is: along the writing element end to the farthest end, the volume of ink cartridge at the far end is greater than or equal to that of ink cartridge at the near end.

13. The liquid ink writing instrument according to claim 1, wherein the fiber ink feeder is provided with an axial limiting step along the axis of the air-liquid balancer at a farthest end of the writing element, and a circumferential surface of the axial limiting step is made with slotted holes to permit contact of the ink in the ink cartridge with the fiber ink feeder.

14. The liquid ink writing instrument according to claim 1, wherein the air-liquid exchange groove of the air-liquid balancer, which is starting from a writing element end, is communicated with an external environment through an air passage on an inner wall of the pen body.

* * * * *